US008454131B2

(12) United States Patent
Murakami et al.

(10) Patent No.: US 8,454,131 B2
(45) Date of Patent: Jun. 4, 2013

(54) INK JET PRINT HEAD

(75) Inventors: Shuichi Murakami, Kawasaki (JP); Masataka Eida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 1463 days.

(21) Appl. No.: 12/060,029

(22) Filed: Mar. 31, 2008

(65) Prior Publication Data

US 2008/0246813 A1 Oct. 9, 2008

(30) Foreign Application Priority Data

Apr. 4, 2007 (JP) ..... 2007-098470

(51) Int. Cl.
*B41J 2/06* (2006.01)
*B41J 2/04* (2006.01)

(52) U.S. Cl.
USPC ..... 347/54; 56/61; 56/93; 56/30

(58) Field of Classification Search
USPC ..... 347/54, 56, 61, 65, 30, 93
See application file for complete search history.

(56) References Cited

U.S. PATENT DOCUMENTS 7,470,004 B2 * 12/2008 Eguchi et al. ..... 347/65

FOREIGN PATENT DOCUMENTS

JP 58-008658 A 1/1983

* cited by examiner

*Primary Examiner* — Kevin S Wood
(74) *Attorney, Agent, or Firm* — Canon USA Inc IP Division

(57) ABSTRACT

An ink jet print head is provided which, during a suction-based recovery operation, can effectively remove air bubbles from the common ink path by producing an ink flow in the common ink path. In each of a plurality of bubble forming chambers where an element is installed to generate a thermal energy, there are provided a first ink path for leading ink directly from the ink supply port and a second ink path for leading ink from the common ink path formed on a far side of the array of the bubble forming chambers with respect to the ink supply port. The plurality of the first ink paths include those ink paths with less flow resistance than that of the second ink paths and those ink paths with higher flow resistance than that of the second ink paths.

6 Claims, 11 Drawing Sheets

INK JET PRINT HEAD

BACKGROUND OF THE INVENTION

1. Field of the Invention

The present invention relates to an ink jet print head and more particularly to an ink jet print head suited for a suction-based recovery operation that involves drawing ink from ink ejection openings to keep an ink ejection performance in good condition or recover the original ink ejection performance.

2. Description of the Related Art

There are growing demands in recent years for higher print resolution and higher print speed in ink jet printing apparatuses.

Among the means to enhance the print resolution is a use of an ink jet print head (hereinafter referred to simply as a print head) which has nozzles arranged at high density. The nozzle generally includes an ink ejection opening for ejecting ink, an element to generate energy to cause the ink to be ejected, an energy application chamber accommodating this energy generation element to apply the generated energy to ink, and a flow path communicating with the energy application chamber to supply ink to the chamber.

One of the means to enhance the printing speed is to improve an ejection frequency of the ink jet print head. One factor that determines an upper limit of the ejection frequency of the print head is a time it takes for the nozzle to be refilled with a supplied ink after it has ejected ink (hereinafter referred to as a refill time). Thus, the shorter the refill time, the higher the ejection frequency at which the printing can be executed.

FIG. 1 is a schematic plan view showing a construction of a flow path used in a conventional ink jet print head. In this flow path construction, there is an energy application chamber (bubble forming chamber) 5 in which an electrothermal transducing element 1 is installed to cause film boiling in ink to generate energy for ink ejection. An ejection opening is provided to face the bubble forming chamber 5 in a direction perpendicular to the plane of the drawing (Z direction). Ink is supplied in a Y direction to the bubble forming chamber 5 through one ink path 7. Reference number 6 denotes a filter installed near an inlet of the ink path to filter out air bubbles and foreign substances to prevent them from entering into the nozzle. In a print head with this flow path construction, the refill time tends to be dependent on a pitch of the nozzles. That is, when the resolution is increased, the nozzles are arranged at high density, which in turn reduces the size of the liquid path, increasing the flow resistance of ink.

Another flow path construction, such as shown in FIG. 2, is known which is intended to reduce the refill time. In this flow path construction, two flow paths 7 are formed, one on each side of the bubble forming chamber 5, to allow the ink to be supplied from two directions, which reduces the refill time.

In the conventional ink jet print head of FIG. 1, since a flow path forming member 4 in the nozzle is arranged unsymmetrical with respect to an X direction center axis of the electrothermal transducing element 1, ink ejected in a Z direction may sometimes deviate in a direction not perpendicular to a plane of the electrothermal transducing element 1 but diagonally to it.

In the construction of FIG. 2 disclosed in Japanese Patent Laid-Open No. 58-8658, on the other hand, the flow path forming member 4 is symmetrical with respect to the X direction center axis of the electrothermal transducing element. So, the ink ejected in the Z direction can be made to deviate perpendicular to the plane of the electrothermal transducing element.

FIG. 3 is a conceptual diagram showing an example construction of a substrate of the ink jet print head with the flow path forming member 4 of FIG. 2. In this construction, nozzle arrays are arranged on both sides of one ink supply port 3 in the substrate. To the bubble forming chamber 5 of each nozzle, ink is supplied through an ink path 7 facing the ink supply port 3 and also through a common ink path 8 running parallel to, and at the far side or back side, of each nozzle array.

Generally, when mounted to a printer body, the ink jet print head performs a recovery operation to fill nozzles with ink and to remove air bubbles remaining in the nozzles. The recovery operation is executed by holding a cap member against an ejection opening-formed surface of the print head and depressurizing the inside of the cap member as by a pump to apply a suction force to the nozzles.

However, in the construction in which ink flows at the back of the nozzle arrays as shown in FIG. 3, air bubbles may get trapped in the common ink path 8. This is because ink is more easily supplied to the ejection opening directly through the ink supply port 3 than through the common ink path. Therefore, the ink flow is retarded, resulting in air bubbles remaining in the common ink path 8.

This phenomenon becomes more conspicuous as the number of nozzles allocated to one ink supply port 3 increases. For example, in a print head with 128 nozzles in one nozzle array, during the suction-based recovery operation, ink flows from both sides into the bubble forming chambers of a few nozzles situated at the end of the nozzle array. However, for the nozzles at the central part of the nozzle array, ink flows in mostly from the ink supply port 3 side, with only a small volume of ink flowing in from the common ink path 8. This is explained as follows. Since at the end of the nozzle array the distance from the ink supply port 3 to the common ink path 8 is short, the ink in the common ink path 8 flows easily. However, it becomes harder for the ink to flow as it moves toward the central part of the array. As to the ink flow into the bubble forming chamber when a suction force is applied, the flow from the ink path 7 facing the ink supply port 3 is dominant while the ink in the common ink path 8 is stagnant, sometimes almost not moving. As described above, in the common ink path 8, the ink flow is less active and bubbles may become difficult to remove.

SUMMARY OF THE INVENTION

The present invention is directed to an ink jet print head that can effectively remove air bubbles from the common ink path during a suction-based recovery operation by creating a desirable ink flow in the entire common ink path.

According to an aspect of the present invention, the ink jet print head of this invention includes an ink supply port, a plurality of energy application chambers arrayed along the ink supply port and configured to apply ink ejection energy to ink, a plurality of first ink paths to lead ink from the ink supply port to each of the plurality of energy application chambers, and a plurality of second ink paths to lead ink to each of the plurality of energy application chambers from a common ink path formed on a far side of the array of the energy application chambers with respect to the ink supply port. Some of the first ink paths have a lower flow resistance than that of the second ink paths and some of the first ink paths have a higher flow resistance than that of the second ink paths.

With the above construction, it is possible to provide nozzles through which ink can flow easily from the ink supply port to the ejection opening and nozzles through which ink cannot flow easily from the ink supply port to the ejection opening. This in turn creates an ink flow in the common ink path thereby effectively removing air bubbles from the common ink path.

Further features of the present invention will become apparent from the following description of exemplary embodiments (with reference to the attached drawings).

DESCRIPTION OF THE EMBODIMENTS

Now, embodiments of the present invention will be explained by referring to the accompanying drawings.

First Embodiment

Figure 4:
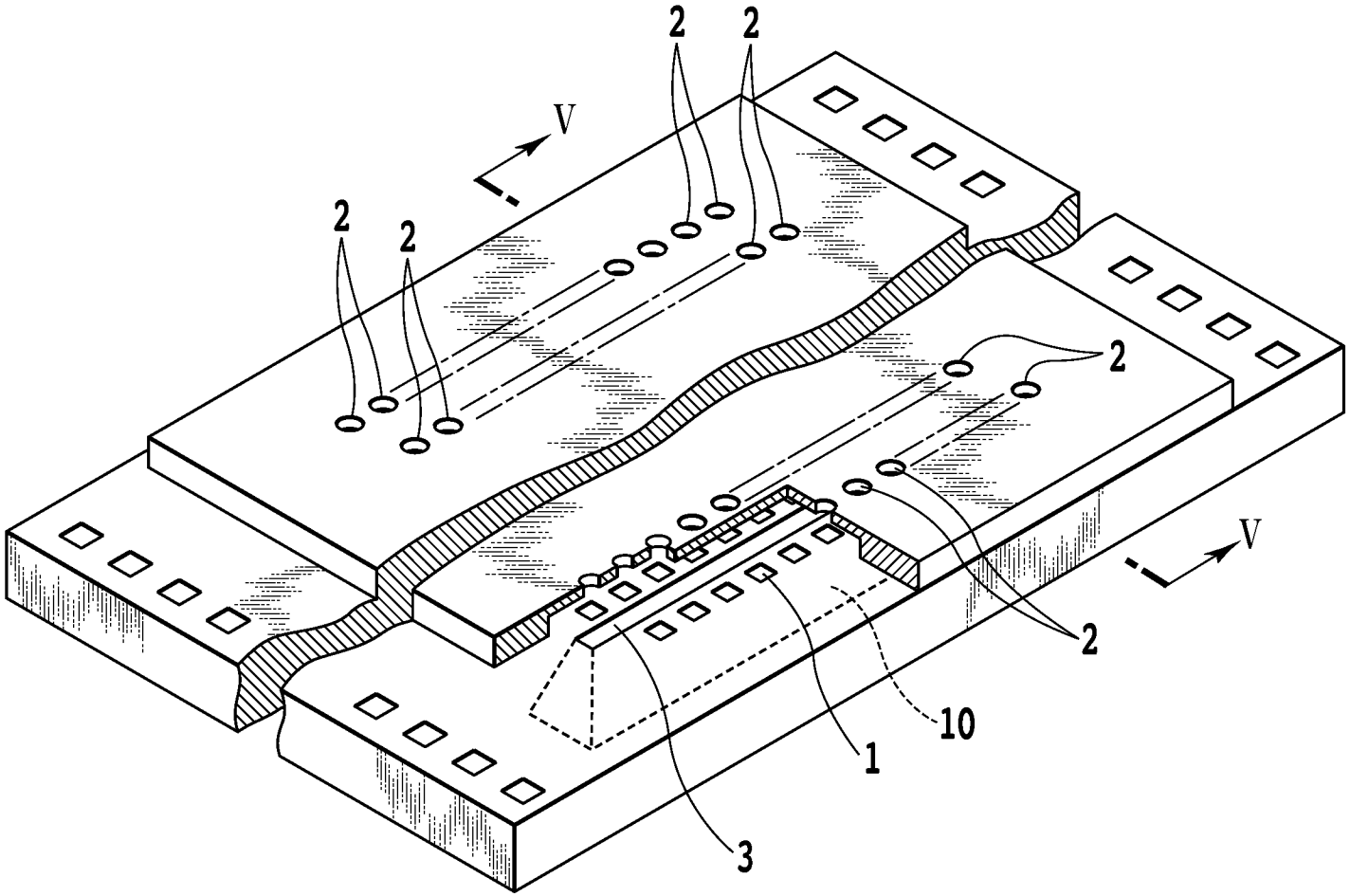
FIG. 4 is a perspective view showing an ink jet print head as a first embodiment of this invention.
Figure 5:
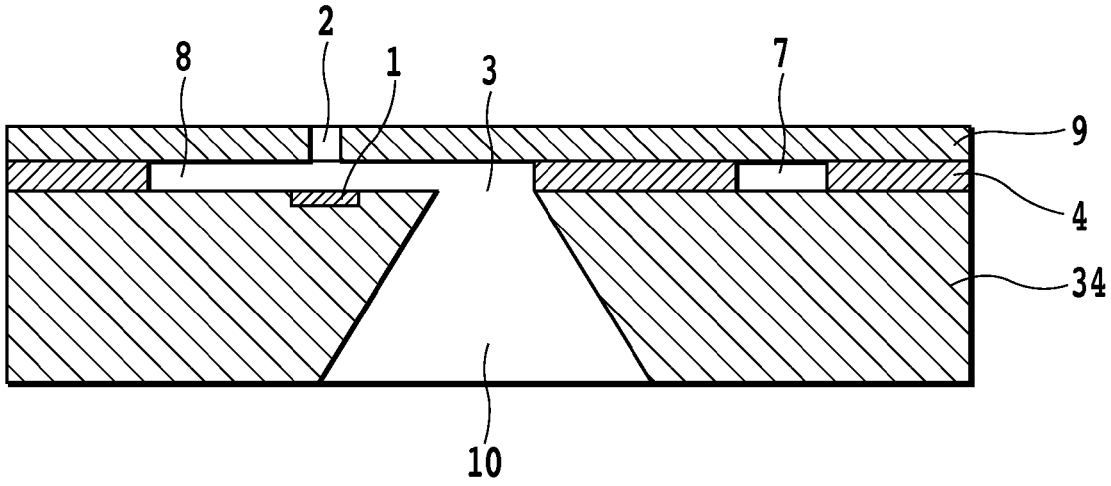
FIG. 5 is a cross-sectional view taken along the line V-V of FIG. 4.

FIG. 4 is a perspective view of an ink jet print head as the first embodiment of this invention. FIG. 5 is a cross-sectional view taken along the line V-V of FIG. 4. These and other drawings do not show electrical wiring to power electrothermal transducing elements 1, elements to generate energy for ink ejection.

As shown in these figures, a substrate 34 has, formed on its upper surface, electrothermal transducing elements 1 to generate an ink ejection energy and a narrow rectangular ink supply port 3. The ink supply port 3 is formed as an opening for an elongate groove-shaped ink supply chamber 10 that pierces through the substrate 34 between its upper and lower surfaces. The electrothermal transducing elements 1 are arrayed in two lines extending longitudinally on both sides of the ink supply port 3 at a pitch of 600 dpi. The two arrays of electrothermal transducing elements 1 are formed staggered from each other by half a pitch. Also on the upper surface of the substrate 34 is arranged a flow path forming member 4, on which an ejection opening plate 9 is laid. The flow path forming member 4 forms a separation wall to lead ink supplied from the ink supply port 3 to individual electrothermal transducing elements 1. The ejection opening plate 9 is formed with ejection openings 2 at positions facing the electrothermal transducing elements 1. With these put on the substrate 34, a plurality of ink paths 7 are formed and at the same time bubble forming chambers 5, as the energy application chambers, are formed at positions facing the ejection openings 2.

Although silicon can be used as the material for the substrate 34, any desired material may be used as long as they can be formed with the electrothermal transducing elements and function as a support for layers of ink paths 7 and ejection openings 2. They may include, for example, glass, ceramics, plastics, and metals. The ejection opening plate 9 and the flow path forming member 4 may be formed from the same member or different members.

Figure 6:
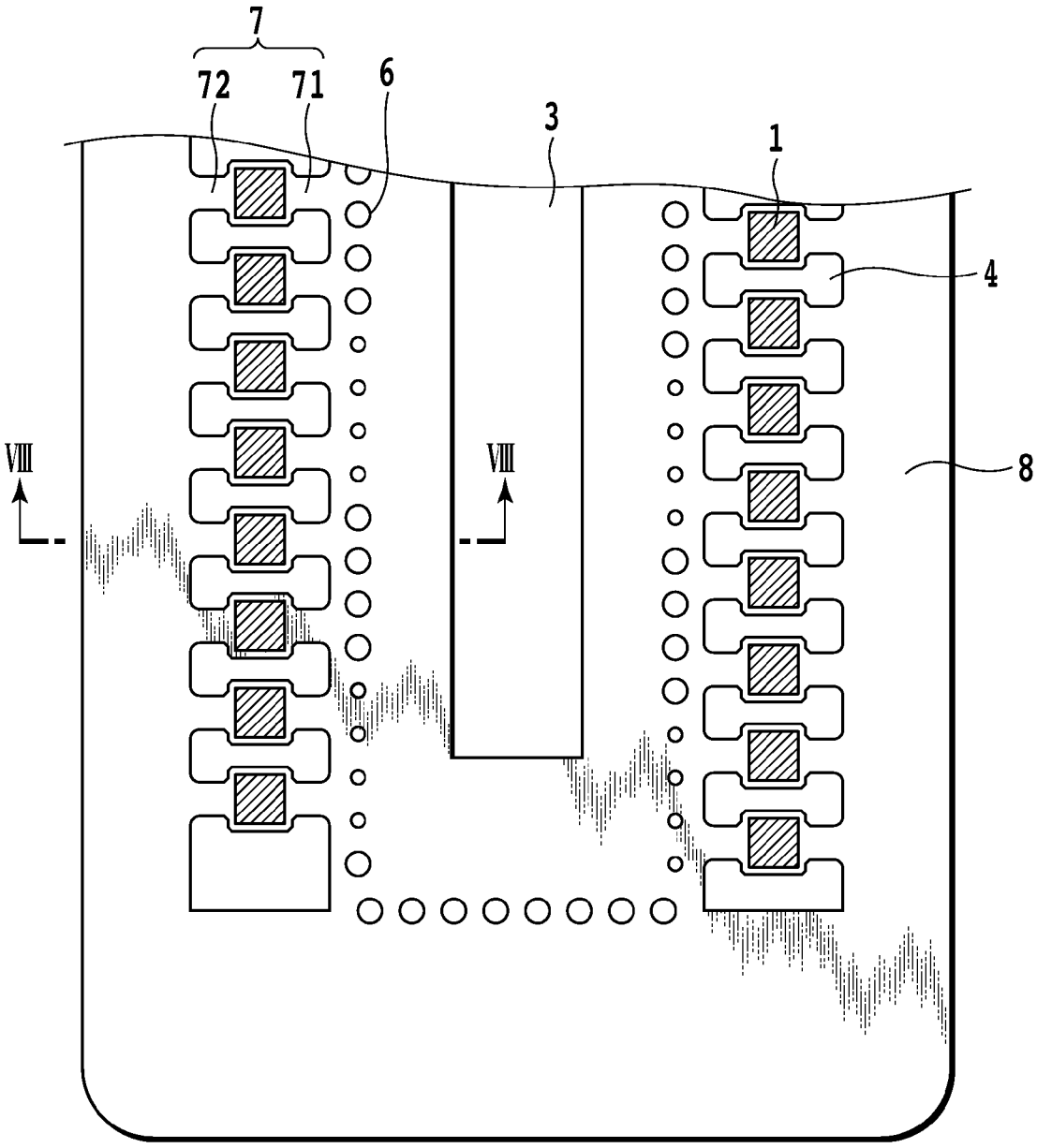
FIG. 6 is a front view showing the ink ejection portion formed in the ink jet print head substrate of FIG. 4.
Figure 7:
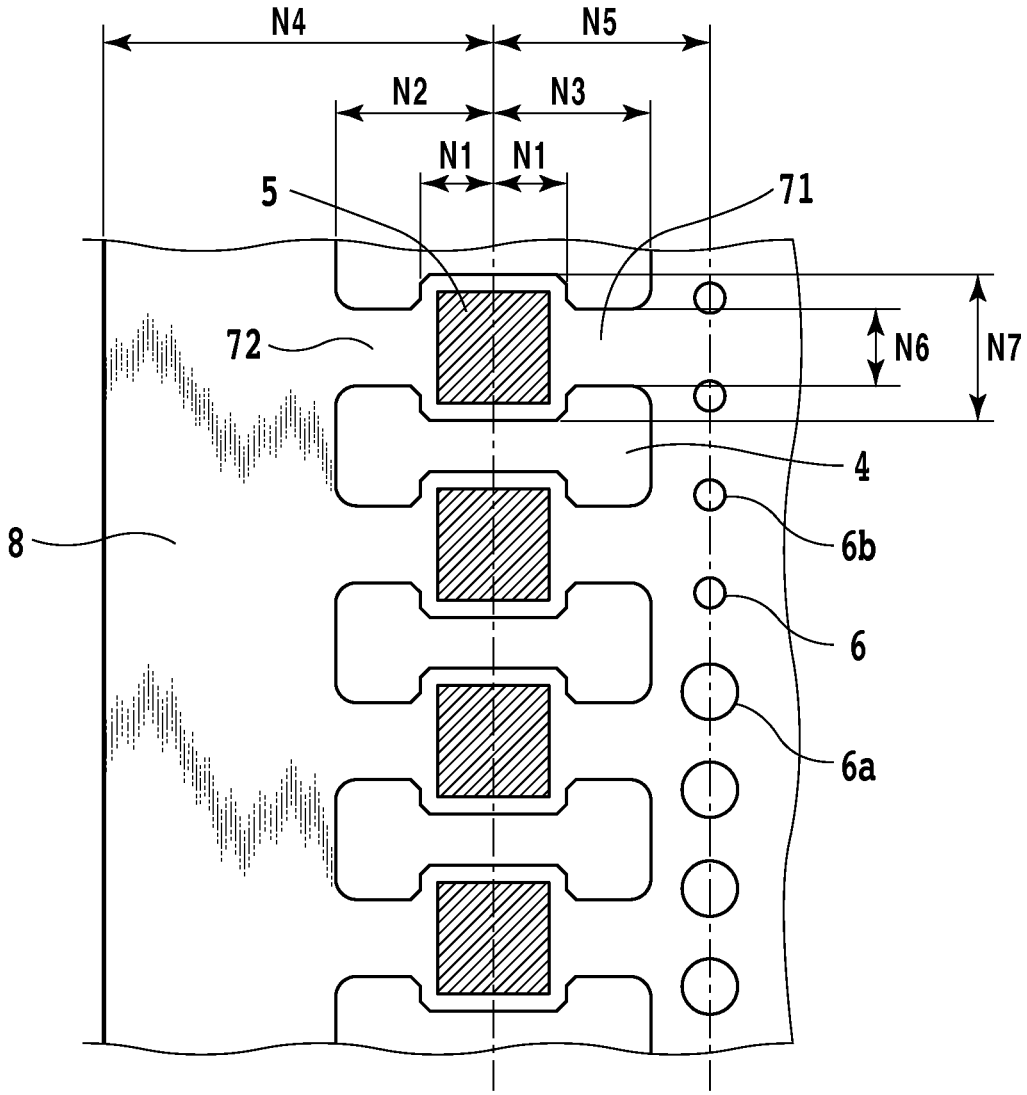
FIG. 7 is an enlarged front view showing the ink ejection portion of FIG. 6.
Figure 8:
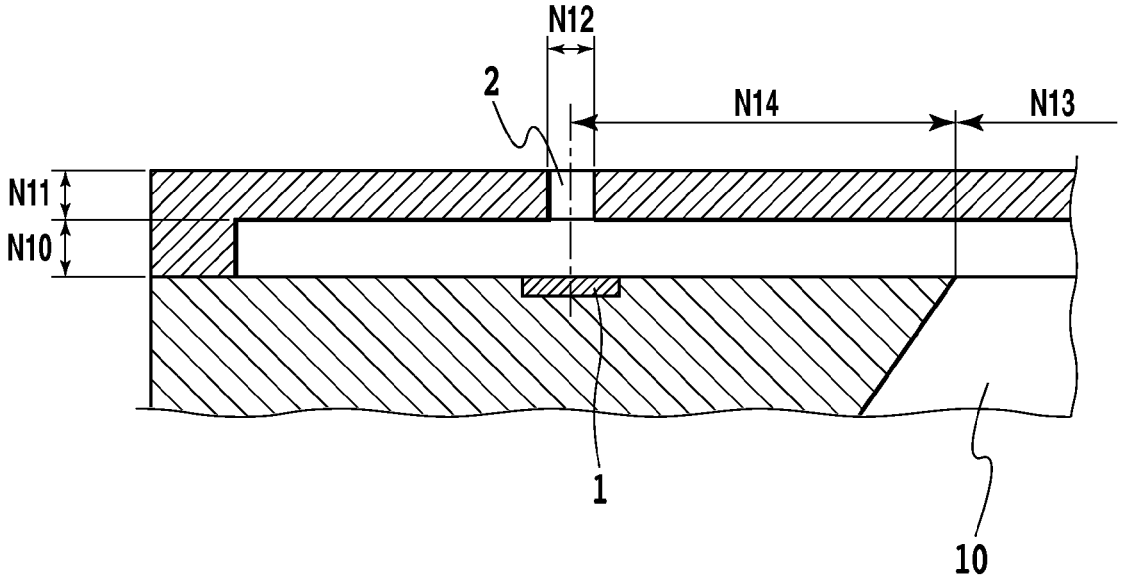
FIG. 8 is a cross-sectional view taken along the line VIII-VIII of FIG. 6.

FIG. 6 is a front view showing the ink jet print head substrate of FIG. 4, with the ejection opening plate 9 removed. FIG. 7 is a partly enlarged view of FIG. 6. FIG. 8 is a cross-sectional view taken along the line VIII-VIII of FIG. 6.

As shown in FIG. 6, an ink path 7 for each bubble forming chamber 5 comprises two ink paths, i.e., a first ink path 71 to introduce the ink flowing in directly from the ink supply port 3 into the bubble forming chamber 5 and a second ink path 72 to introduce into the bubble forming chamber 5 the ink flowing in through the common ink path 8 situated on the far side of the nozzle array with respect to the ink supply port 3. The first ink path 71 and the second ink path 72 are located symmetrically with respect to the bubble forming chamber 5 in this embodiment.

Also as shown in FIG. 6, on the substrate 34 are erected a plurality of columns of nozzle filters 6 along long and short sides of the ink supply port 3. Near an inlet of each of the first ink paths 71, arranged along the long sides of the ink supply port 3, there are provided two nozzle filters 6. The nozzle filters 6 along the short sides of the ink supply port 3 are provided in the common ink path leading to the second ink paths 72 on the far side of the nozzle array. The nozzle filters 6 can be formed in the same manufacturing step as that of the flow path forming member 4, by using the same material as the flow path forming member 4.

This embodiment reliably removes air bubbles by setting an appropriate size (diameter) of the nozzle filters 6 arranged near the inlet of each of the first ink paths 71 to cause a desirable ink flow during the suction-based recovery operation. This is explained in the following using example measurement values.

In FIG. 8, suppose that a height of the ink path (N10) is 14 μm, a thickness of the ejection opening plate (N11) is 11 μm, and a diameter of the ejection openings (N12) is 12 μm. Also, suppose that a width of the ink supply port (N13) is 112 μm and a distance from the edge of the ink supply port to the center of the electrothermal transducing elements 1 (N14) is 70 μm.

In FIG. 7, it is assumed that a distance from the center of the bubble forming chamber to its edge is N1=16 μm. It is also assumed that a distance from the center of the bubble forming chamber to the edge of the second ink paths 72 facing the common ink path 8 is N2=34 μm and that a distance from the center of the bubble forming chamber to the edge of the first ink paths 71 is also N3=34 μm. Further suppose that a distance from the center of the bubble forming chamber to the side wall that defines the common ink path 8 is N4=84 μm and a distance from the bubble forming chamber to the center of the nozzle filters 6 is N5=47 μm. Further suppose that a width of the ink path is N6=17 μm and a width of the bubble forming chamber is N7=32 μm.

As shown in FIG. 7, this embodiment handles two adjacent bubble forming chambers as one set and uses nozzle filters of two different diameters alternately by assigning one size of nozzle filters to one set of bubble forming chambers and another size of nozzle filters to the next adjacent set. Since two nozzle filters are provided for each bubble forming chamber, four nozzles of relatively large diameter 6*a* and four nozzles of relatively small diameter 6*b* are arranged alternately along the first ink paths 71. More specifically, the large-diameter nozzle filters 6*a* are 12 μm in diameter and the small-diameter nozzle filters 6*b* are 6 μm in diameter.

As described above, a resistance is changed to the flow from the ink supply port to the bubble forming chamber for each set of nozzles in this embodiment. With this arrangement, nozzles with the small-diameter nozzle filters 6*b* have a wide inlet opening to the first ink path 71, making it easier for the ink to flow into the bubble forming chamber from the ink supply port 3 through the first ink path 71 than from the common ink path 8 through the second ink path 72. For nozzles with the large-diameter nozzle filters 6*a*, an inlet opening to the first ink path 71 is narrow so that the ink flows more easily into the bubble forming chamber from the common ink path 8 through the second ink paths 72 than from the ink supply port 3 through the first ink paths 71.

Figure 9:
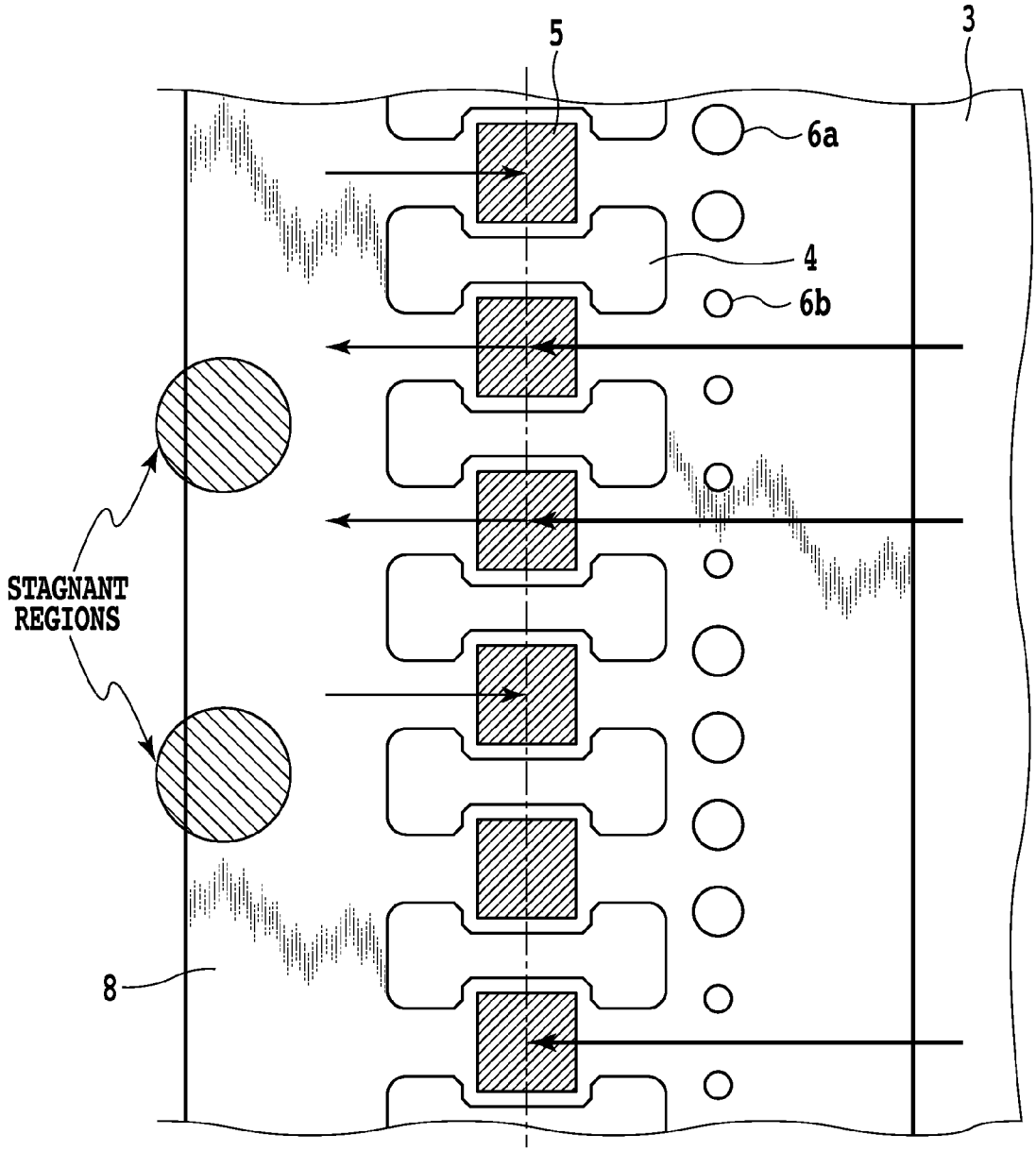
FIG. 9 is a schematic diagram showing a fluid simulation result when a suction-based recovery operation is performed on ejection openings in the first embodiment of this invention.

FIG. 9 is a schematic diagram showing a result of fluid simulation when a suction-based recovery operation is performed on the ejection openings in this embodiment. When during the suction-based operation a suction force is applied to the ejection openings, ink flows into the ejection openings through whichever ink path has less flow resistance. That is, for the nozzles with the large-diameter nozzle filters 6*a*, ink flows in mostly through the second ink paths 72 and is drawn out from the ejection openings. For the nozzles with the small-diameter nozzle filters 6*b*, on the other hand, ink flows in mainly from the ink supply port 3 through the first ink paths 71, and ink that has failed to be drawn out from the ejection openings flows into the common ink path 8 through the second ink paths 72. That is, in an operation to discharge ink from the ejection openings by applying a suction force to the ejection openings, the plurality of first ink paths 71 includes first ink paths with a greater volume of flow than that of the second ink paths and a first ink paths with a smaller volume of flow than that of the second ink paths. Since a desirable ink flow occurs also in the common ink path 8 as described above, air bubbles remaining there can be removed effectively.

Figure 1:
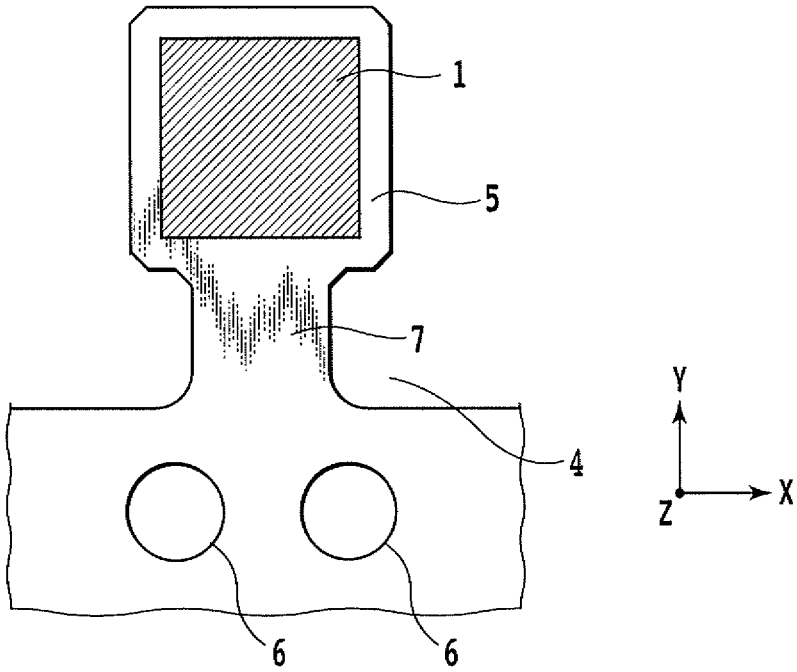
FIG.1 (PRIOR ART)
FIG. 1 shows conventional a flow path forming member.
Figure 2:
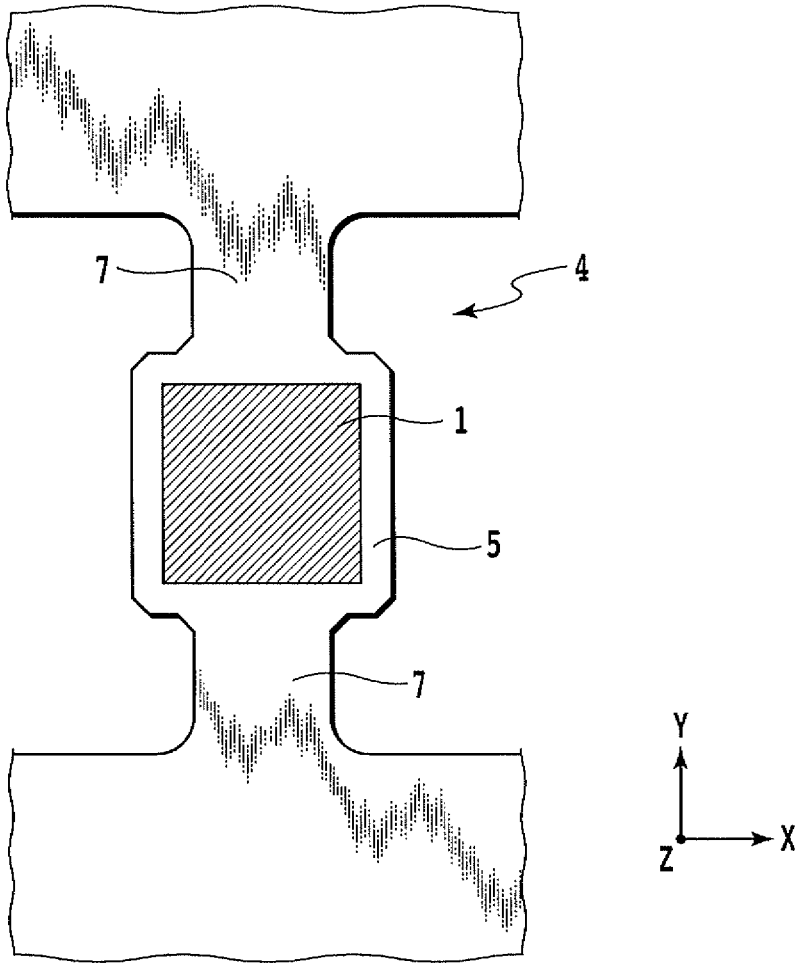
FIG.2 (PRIOR ART)
FIG. 2 shows another conventional flow path forming member.
Figure 3:
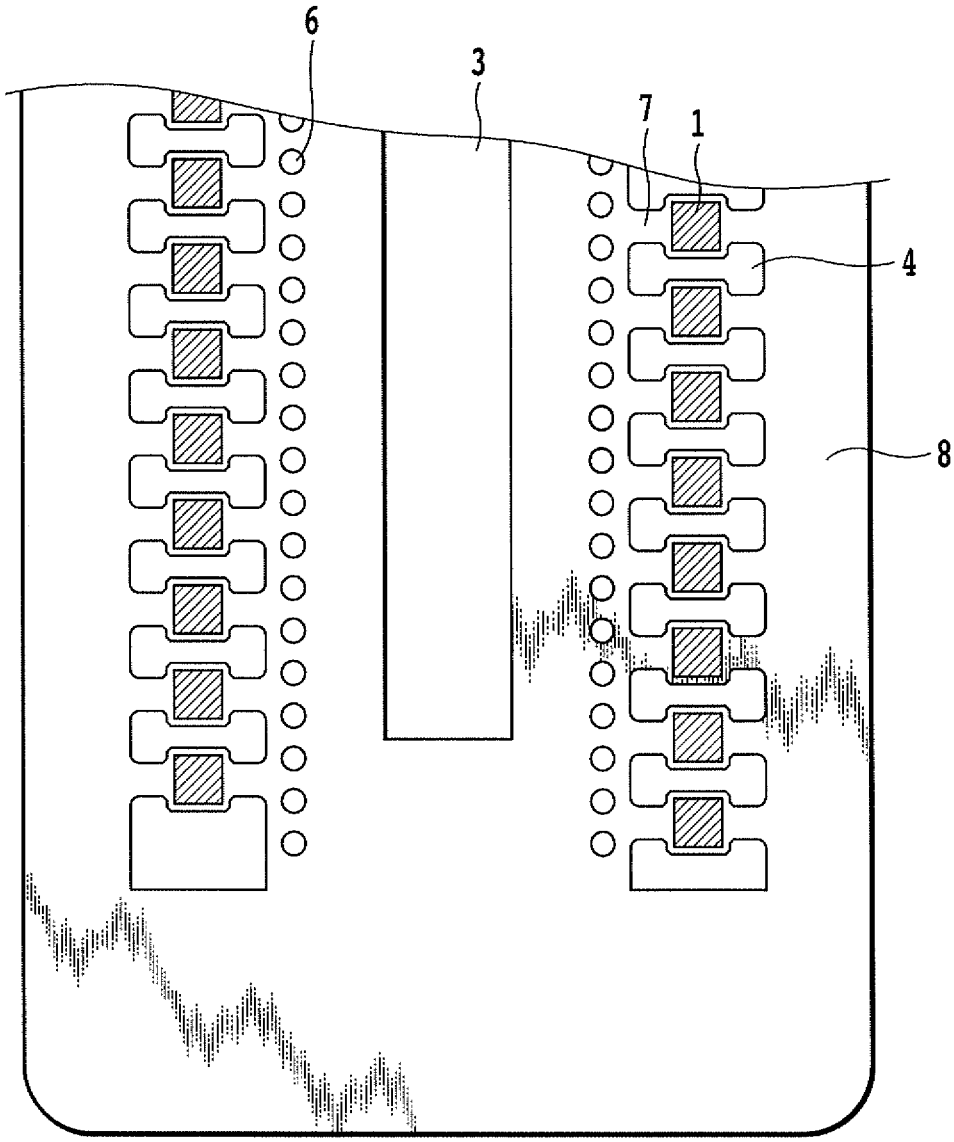
FIG.3 (PRIOR ART)
FIG. 3 is a conceptual diagram showing an example ink ejection portion in an ink jet print head substrate with the flow path forming member of FIG. 2.

The inventor of this invention performed a suction-based recovery operation on a print head of this embodiment with the above specifications and on a print head of the structure of conceptual diagram shown FIG. 3 (with only small-diameter nozzle filters). More specifically, this verification test involves mounting in an ink jet printing apparatus these print heads, one at a time, which have the ejection opening plate 9 formed of a transparent member, performing the suction-based recovery operation, dismounting the print heads, and observing from the front the ejection opening-formed surface of the print head by using microscope to see if there are any air bubbles remaining in the common ink path 8. The observation has found that in the conventional print head air bubbles remain in the common ink path 8, whereas in the structure of this embodiment no air bubbles has been found to remain in the common ink path 8.

While, in this embodiment, two nozzles are taken as one set that has the same size of nozzle filters, the present invention is not limited to this arrangement. That is, three or more nozzles may be taken as one set, or a large-diameter nozzle filter and a small-diameter nozzle filter may be alternated for each nozzle. In other words, there is no limitation on the number of nozzles taken as one set. It should be noted, however, that if the number of nozzles as one set is increased, the distance the ink must move in the common ink path increases, making it likely for the bubble removing performance to deteriorate. So the determination of the number of nozzles in one set should take this into consideration.

Where the diameters of the ejection openings differ in the same nozzle array, the flow resistance during the suction operation changes with the size of the individual ejection openings. So, the nozzle filter diameter and the ink path width may be changed accordingly.

Second Embodiment

Figure 10:
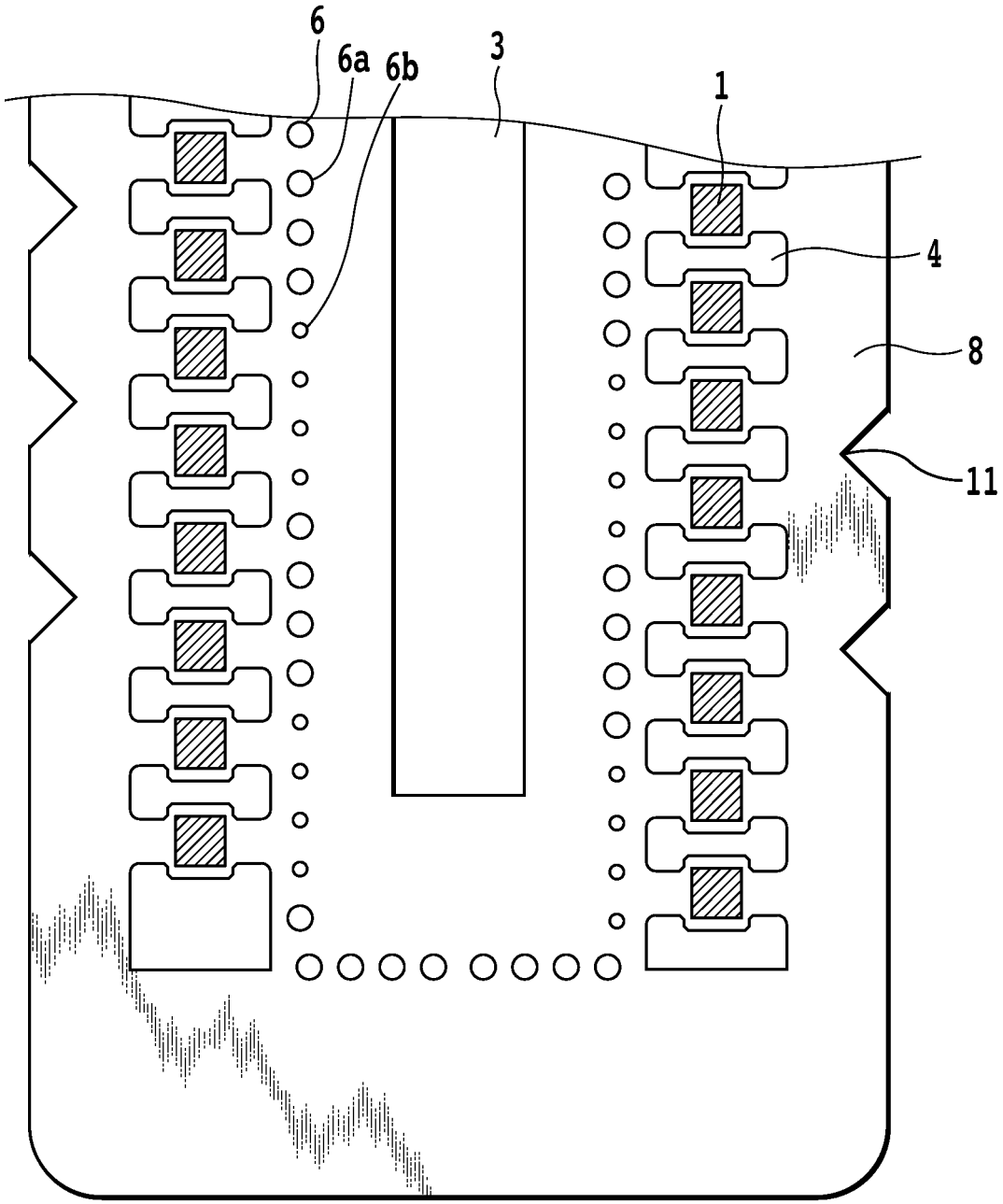
FIG. 10 is a front view showing an ink ejection portion formed in the ink jet print head substrate of a second embodiment of this invention.

FIG. 10 is a front view of an ink jet print head substrate of the second embodiment with the ejection opening plate 9 removed.

The print head substrate of this embodiment has a flow path control structure 11 formed at a center of that area of the common ink path 8 which is situated on the far side of one set of nozzles in the first embodiment. In the first embodiment, as shown in FIG. 9, stagnant regions may occur in a region of the common ink path 8 at the far side of one set of nozzles having nozzle filters of relatively large diameter.

That is, in the common ink path there is a possibility of the ink flow being stagnant in an area between adjacent nozzles having small-diameter nozzle filters and in an area between adjacent nozzles having large-diameter nozzle filters.

Therefore, by providing the flow path control structure 11 in a region where the ink flow may become stagnant as described above, a desirable flow can be produced more easily to reduce the stagnant area. This in turn improves the bubble removing performance during the suction-based recovery operation.

In this embodiment, the flow path control structure 11 is situated at almost the center of a group of adjacent nozzle filters of the same diameters. Such a position is where the likelihood of the ink flow being stagnant is relatively high, so the flow path control structure 11 can create a more desirable flow in the common ink path 8. It is noted, however, that the present invention is not limited to such a position and that any desired position other than the approximate center of a group of filters of the same diameters may be used as long as it can create a desirable flow in the common ink path 8.

Third Embodiment

While in the preceding embodiments the flow resistance is changed by using nozzle filters of two different diameters, other structures may be employed to change the flow resistance.

Figure 11:
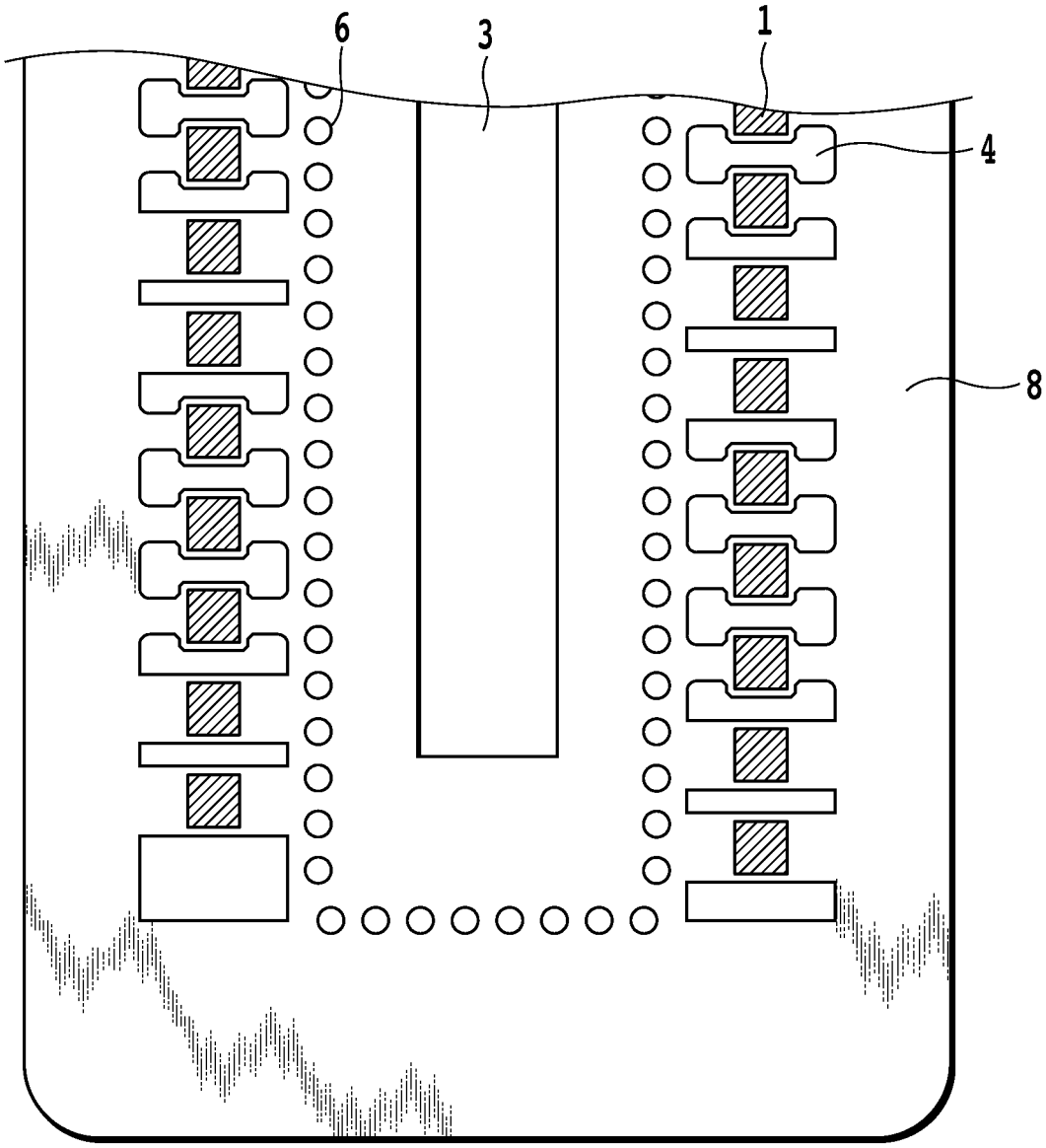
FIG. 11 is a front view showing an ink ejection portion formed in the ink jet print head substrate of a third embodiment of this invention.

FIG. 11 is a front view showing an ink jet print head substrate of the third embodiment with the ejection opening plate 9 removed.

In this embodiment, it is assumed that a height of the flow path is 14 μm, that a thickness of the ejection opening plate is 11 μm, that a diameter of ejection openings is 12 μm, that a width of the ink supply port may be designed at any desired value, and that a distance from the ink supply port to the center of the electrothermal transducing element is 70 μm. The common ink path 8 communicates with the end of the ink supply port 3 so that ink is supplied from both sides of the nozzle array. It is also assumed that a width of the common ink path is 50 μm.

In this embodiment, only the nozzle filters of the same diameters are used and the cross-sectional size (width) of a nozzle inlet between the ink supply port 3 and the bubble forming chamber 5 is changed every two nozzles so as to change the flow resistance for each set of two nozzles. It is assumed that a width of a wider nozzle inlet is 32 μm and that of a narrower nozzle inlet 17 μm. In this construction also, ink flows from the ink supply port through a wider nozzle inlet. Ink further flows through the common ink path and enters through a narrower nozzle inlet into the ejection opening. As a result, an ink flow is created between the nozzle filter and the common ink path thus removing air bubbles.

(Others)

In the preceding embodiments, an ink jet print head substrate with noise filters has been described. The present invention, however, is not limited to this construction and may be applied to any desired construction, the only requirement being that the first ink paths 71 each have an ink path with a higher flow resistance than that of the second ink paths 72 and an ink path with a lower flow resistance than that of the second ink paths 72.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-098470, filed Apr. 4, 2007, which is hereby incorporated by reference herein in its entirety.

What is claimed is:

1. An ink jet print head comprising:

an ink supply port;

a plurality of energy application chambers arrayed along the ink supply port and configured to apply ink ejection energy to ink;

a plurality of first ink paths to lead ink from the ink supply port to each of the plurality of energy application chambers; and a plurality of second ink paths to lead ink to each of the plurality of energy application chambers from a common ink path formed on a far side of the array of energy application chambers with respect to the ink supply port, wherein the plurality of first ink paths include low first ink paths that have a lower flow resistance than that of the second ink paths and high first ink paths that have a higher flow resistance than that of the second ink paths, and wherein at least two or more of the first ink paths are arranged mutually adjacent and at least two or more of the high first ink paths are arranged mutually adjacent.

2. An ink jet print head according to claim 1, further comprising filters installed at an inlet of the first ink path from the ink supply port, wherein the filters are differentiated in size to provide the high first ink paths and the low first ink paths.

3. An ink jet print head according to claim 1, wherein the first ink paths are differentiated in cross-sectional size to provide the high first ink paths and the low first ink paths.

4. An ink jet print head according to claim 1, further comprising a set of two adjacent high first ink paths and a set of two adjacent low first ink paths, the sets of two adjacent high first ink paths and two adjacent low first ink paths being arranged alternately.

5. An ink jet print head according to claim 1, wherein the common ink path is provided with a flow path control structure configured to prevent stagnant flow in the common ink path during an operation of discharging ink by applying a suction force to ejection openings.

6. An ink jet print head according to claim 5, wherein the flow path control structure is provided at almost a center, in a direction of an array of the energy application chambers, of a set of adjacent ink paths with the same filter sizes.

* * * * *